US006402927B1

(12) United States Patent
Duruz et al.

(10) Patent No.: US 6,402,927 B1
(45) Date of Patent: Jun. 11, 2002

(54) DISTRIBUTION OF ALUMINA-RICH ELECTROLYTE IN ALUMINUM ELECTROWINNING CELLS

(75) Inventors: Jean-Jacques Duruz, Geneva (CH); Vittorio Bello, Rome (IT)

(73) Assignee: Moltech Invent S.A. Luxembourg (LU)

( * ) Notice: Subject to any disclaimer, the term of this patent is extended or adjusted under 35 U.S.C. 154(b) by 0 days.

(21) Appl. No.: 09/636,661

(22) Filed: Aug. 11, 2000

Related U.S. Application Data

(63) Continuation of application No. PCT/IB98/00162, filed on Feb. 11, 1999.

(51) Int. Cl.[7] ..... C25C 3/06; C25C 3/08

(52) U.S. Cl. ..... 205/375; 205/381; 205/389; 205/392; 204/225; 204/245; 204/294

(58) Field of Search ..... 204/245; 205/372, 205/381, 389, 384, 385, 380, 392, 375

(56) References Cited

U.S. PATENT DOCUMENTS 2,061,146 A * 11/1936 Ferrand ..... 204/247
2,564,837 A * 8/1951 Ferrand ..... 204/247
3,400,061 A * 9/1968 Lewis et al. ..... 205/375
3,501,386 A * 3/1970 Johnson ..... 205/381
3,994,797 A * 11/1976 Smith ..... 204/225
5,683,559 A * 11/1997 de Nora ..... 204/243.1

* cited by examiner

*Primary Examiner*—Donald R. Valentine
(74) *Attorney, Agent, or Firm*—Jayadep R. Deshmukh

(57) ABSTRACT

The invention relates to a method of producing aluminum in an electrolytic cell, particularly in a drained cell, such cell comprising a cathode (20) and facing anodes (10), each anode (10) being spaced apart in its operative position from the cathode (20) by an anode-cathode reduced distance defining an anode-cathode gap containing the bath being electrolyzed. The method comprises: feeding alumina into the electrolyte where it is dissolved; electrolyzing an alumina-rich bath in the anode-cathode gap; and periodically moving at least one anode (10) in order to intake rich-alumina electrolyte into the anode-cathode gap thereby distributing alumina-rich electrolyte under the entire anode surface.

52 Claims, 3 Drawing Sheets

DISTRIBUTION OF ALUMINA-RICH ELECTROLYTE IN ALUMINUM ELECTROWINNING CELLS

This is a continuation of U.S. designation of PCT/IB98/00162 filed Feb. 11, 1999.

FIELD OF THE INVENTION

The present invention relates to a method for producing aluminium in a cell for the electrowinning of aluminium by the electrolysis of alumina dissolved in a fluoride-based molten electrolyte having a reduced anode-cathode distance such as a drained-cathode cell, having means to improve the distribution of dissolved alumina under the anodes to enable the electrolysis of an alumina-rich bath. The invention also relates to a cell having means so arranged to improve the distribution of the alumina-rich electrolyte under the anodes.

BACKGROUND OF THE INVENTION

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

A major drawback of conventional cells is due to he fact that irregular electromagnetic forces create waves in the molten aluminum pool and the anode-cathode distance (ACD), also called inter-electrode gap (IEG), must be kept at a safe minimum value of approximately 5 cm to avoid short circuiting between the aluminium cathode and the anode or re-oxidation of the metal by contact with the $Co_2$ gas formed at the anode surface.

Another drawback of the conventional cells is the anode effect which occurs when the electrolyte in the cells contains insufficient dissolved alumina to ensure a continuous electrolysis thereof and therefore allows the electrolysis of the fluoride-based material contained in the electrolyte which produces fluoride-based gas such as $CF_4$. The fluoride-based gas accumulates under the anodes and greatly inhibits the current transport between the anodes and the cathodes. The anode effect manifests itself by a sudden increase of the cell voltage. The voltage increase can vary from a 7–8 volts up to 30 V in industrial cells.

However, while the anode effect leads to a high energy consumption for several minutes, it is used in some aluminium production to determine the timing for adding fresh alumina into the electrolyte.

Several methods have been applied in order to overcome the anode effect once it has occurred. In addition to feeding the electrolyte with fresh alumina, it is necessary to stir the electrolyte. It can be done manually by using rakes, wooden poles or compressed air, but it can also be done automatically (Grjotheim et al, Aluminium Electrolysis Fundaments of the Hall-Héroult process (1982), pp. 265–281, Aluminium-Verlag Düsseldorf, $2^{nd}$ Edition).

French Patent No. 2.083.362 (Facsko) describes a method to eliminate the anode effect when it occurs by vibrating the carbon anodes between 1 and 300 Hz preferably 50 Hz at an amplitude comprised between 0.01 and 50 mm preferably 1 mm.

In French Patent No. 782.136 (Ferrand) a permanent or intermittent oscillation of the anodes stirs the electrolyte and inhibits the anode effect.

EP Patent application 0 604 664 (Begunov et al.) discloses a method of feeding allmna to the electrolyte of cell for the electrowinning of aluminium. By periodic vertical anode movements, e.g. every 3 hours, alumina accumlated on the electrolyte crust is poured down through a slot along the perimeter of the anode into the molten electrolyte.

Drained cell design have been proposed to avoid the problems of conventional cells, by replacing the pool with a to layer of aluminium which is drained down the surface of the cathode, enabling the Anode-Cathode Distance to be significantly reduced.

U.S. Pat. No. 4,560,488 (Sane/Wheeler/Kuivila) proposed a drained cathode arrangement in which the surface of a carbon cathode block was covered with a sheath that maintained stagnant album on its surface in order to reduce wear. In this design, the cathode block stands on the cell bottom.

An improvement described in U.S. Pat. No. 5,472,578 (de Nora) consisted in using grid-like bodies which could form a drained cathode surface and simultaneously restrain movement in the aluminium pool.

In drained cells without stirring, means to distribute alumina-rich electrolyte in the Inter-Electrode Gap, the electrolyte in areas of the cathodes which are close to the feeding point of alumina contains greater amounts of alumina than remote areas where electrolysis has taken place.

Most of the alumina is electrolyzed on the parts of the cathodes close to the dissolution point, whereas remote areas of the cathodes are depleted with alumina. This is due to the gradual depletion of the alumina concentration in the electrolyte while the electrolyte is moving between the electrodes where its electrolysis takes place. Consequently, such a gradient of dissolved-alumina concentration over the cathode of a drained cell can cause a non-uniform use of the active surfaces of the cathodes and therefore a non-uniform consumption of the electrodes while increasing the risk of a local anode effect due to a locally insufficient concentration of alumina.

While the foregoing references indicate continued efforts to improve the operation of molten cell electrolysis operations, none suggests a design proving the distribution of the dissolved alumina over the whole active surface of a drained cathode configuration.

SUMMARY OF THE INVENTION

It is therefore a preferred object of the invention to provide a drained cell for the electrowinning of aluminium by the electrolysis of alumina dissolved in a fluoride-based melt such as cryolite, designed to ensure an enhanced distribution of alumina dissolved in electrolyte between the active sloping surfaces of the electrodes.

The invention relates to a method of producing aluminium in an electrolytic cell, in particular by the electrolysis of alumina dissolved in a molten fluoride electrolyte, said cell comprising a cathode having an active cathode surface and facing anodes having active anode surfaces. Each anode is spaced apart in its operative position from the cathode by an anode-cathode distance defining an anode-cathode gap containing the electrolyte.

The method of the invention comprises periodically moving at least one anode from and back into its operative position, feeding alumina into the electrolyte where it is dissolved to enrich the electrolyte with alumina and electrolysing in the anode cathode gap electrolyte containing dissolved alumina.

The method is characterised in that the anode is periodically moved from and back into its operative position such that electrolyte enriched with alumina is intaken into the anode-cathode gap under substantially the entire active anode surface of the anode while it is moved during an intake period.

The method of the invention is preferably applied when the cell has drained cathodes, for instance a drained cell as described in U.S. Pat. No. 5,683,559 (de Nora) which advantageously comprises an aluminium collection storage such as a collection groove or channel to collect the product aluminium.

Likewise the method can even be applied in a cell having an aluminium tool, such as a cell containing grid-like bodies as described in U.S. Pat. No. 5,473,578 (de Nova). The method is in particular designed for any cell configuration which lacks an aluminium pool motion stirring the electrolyte and is therefore usually provided with a reduced anode-cathode distance (ACD), such as an ACD between 1.5 and 4.5 cm, preferably between 2 and 3 cm.

Usually the duration between two consecutive intake periods is longer than the duration of an intake periods. The duration between two consecutive intake periods is preferably comprised between 1 and 20 minutes. In conventional cells the anodes are only moved when an anode effect occurs, the time interval between two consecutive anode effects being usually comprised between 1 and 10 days.

To obtain the greatest benefit from the anode motion it is preferable to feed fresh alumina into the electrolyte before and/or during the electrolyte intake period, and before the end of said intake period. However, alumina can also be fed independently of the intake period, in particular alumina can be fed continuously into the cell.

Sufficient fresh alumina should be fed into the electrolyte to ensure a continuous presence thereof for electrolysis, which prevents the anode effect. Ideally the concentration of alumina in the electrolyte contained in the anode-cathode gap is maintained above 1 weight %.

The anodes may be moved according to an identically repeated sequence. For cell design reasons the anodes are preferably moved along a substantially vertical direction.

Usually anodes remain in their operative position for a predetermined period of time between two consecutive intake periods. These periods may be of constant or variable duration.

All the anodes of a cell may be synchronously moved. However, in order to obtain a "wave effect" to bring freshly dissolved alumina from a single feeding point to remote areas of the cell, the anodes may be asynchronously moved. For the same reason the anodes may also be moved asynchronously when a cell comprises several feeding points at different locations and alumina is not fed to all feeding points simultaneously.

In order to save energy the anode-cathode distance is preferably as small as possible during normal operation of the cell but large enough to prevent any short-circuit between the anodes and the cathodes. Therefore, to avoid short-circuits while moving the anodes, the anodes should not come closer to the cathode than when they are in they normal operative position.

The anodes may be raised to an upper position to draw in alumina rich electrolyte into the anode-cathode gap and then lowered back to their operative position. Alternatively the anodes may be raised and partially lowered several times during each intake period.

In any case, the duration of raising the anodes may be either shorter or longer than the duration of lowering the anodes.

To make the cathode surfaces aluminium-wettable the surface may comprise at least one layer of aluminium-wettable refractory material as described in U.S. Pat. No. 5,316,718 (Sekhar/de Nora) or U.S. Pat. No. 5,651,874 (de Nora/Sekhar). In any case, it is preferred to produce aluminium on a substantially dimensionally stable drained cathode.

Likewise, the anodes of the cell are preferably carbon-free and substantially dimensionally stable as described in U.S. Pat. No. 5,510,008 (Sekhar/Liu/Duruz) wherein anodes are obtained by micropyretic reaction followed by surface oxidation. However, the method may also be applied in cells having conventional carbon or carbon-containing anodes.

The invention also relates to an electrolytic cell for the production of aluminium, in particular by the electrolysis of alumina dissolved in a molten fluoride electrolyte. The cell comprises a cathode having an active cathode surface and facing anodes having active anode surfaces. Each anode is spaced apart in its operative position from the cathode by an anode-cathode distance defining an anode-cathode gap containing the electrolyte. The cell has moving means for periodically moving the anodes from and back into their operative position and means for feeding alumina into the electrolyte where it is dissolved to enrich the electrolyte with alumina. Electrolyte containing dissolved alumina is electrolysed in the anode-cathode gap.

The moving means are characterised in that they comprise an automated system which is arranged to periodically move at least one anode from and back into its operative position to intake electrolyte enriched with alumina into the anode-cathode gap under substantially the entire anode active surface of the anode while it is moved.

The automated system would usually comprising motors for moving the anodes and control means for controlling the motors.

The control means advantageously consists of a computerised system comprising a memory device able to store a plurality of programs for periodically generating anode movements and a programmable device designed for carrying out the programs contained in the memory device and to control the motors accordingly.

DESCRIPTION OF THE DRAWINGS

Reference is made to the drawings wherein.

DETAILED DESCRIPTION OF THE INVENTION

Figure 1A:
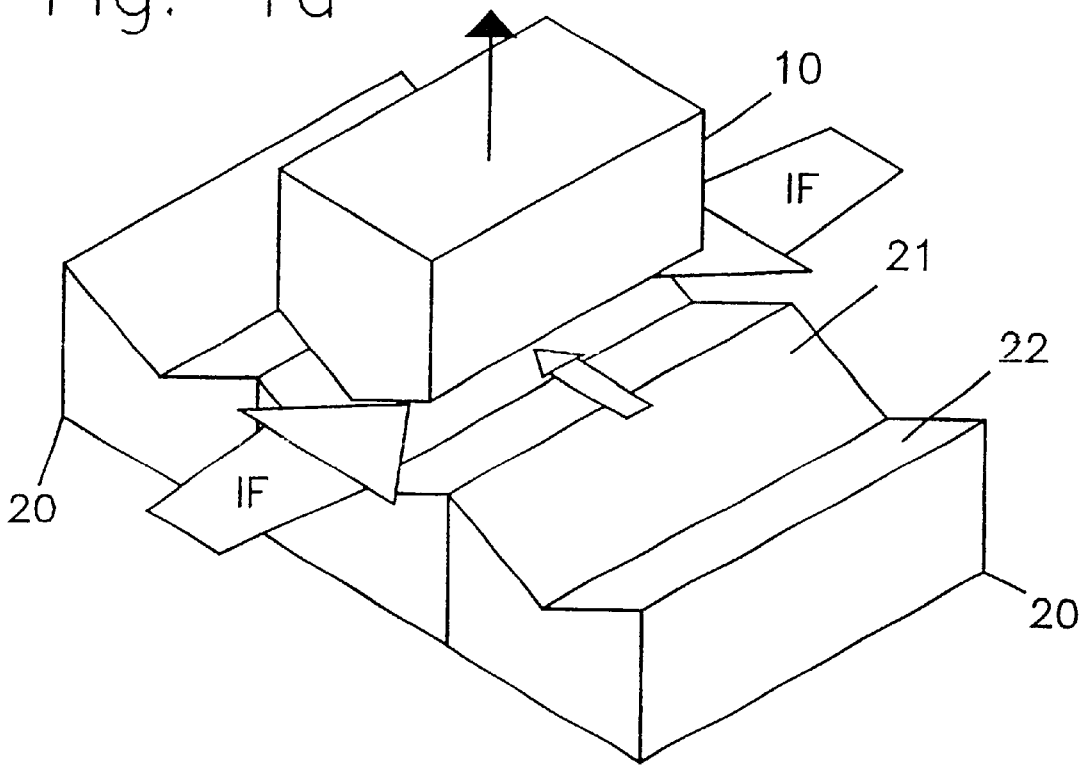
FIGS. 1(*a*) and (*b*) are schematic perspective views of an aluminium electrowinning cell illustrating the electrolyte flow when the anodes are moved in accordance with the invention.
Figure 1B:
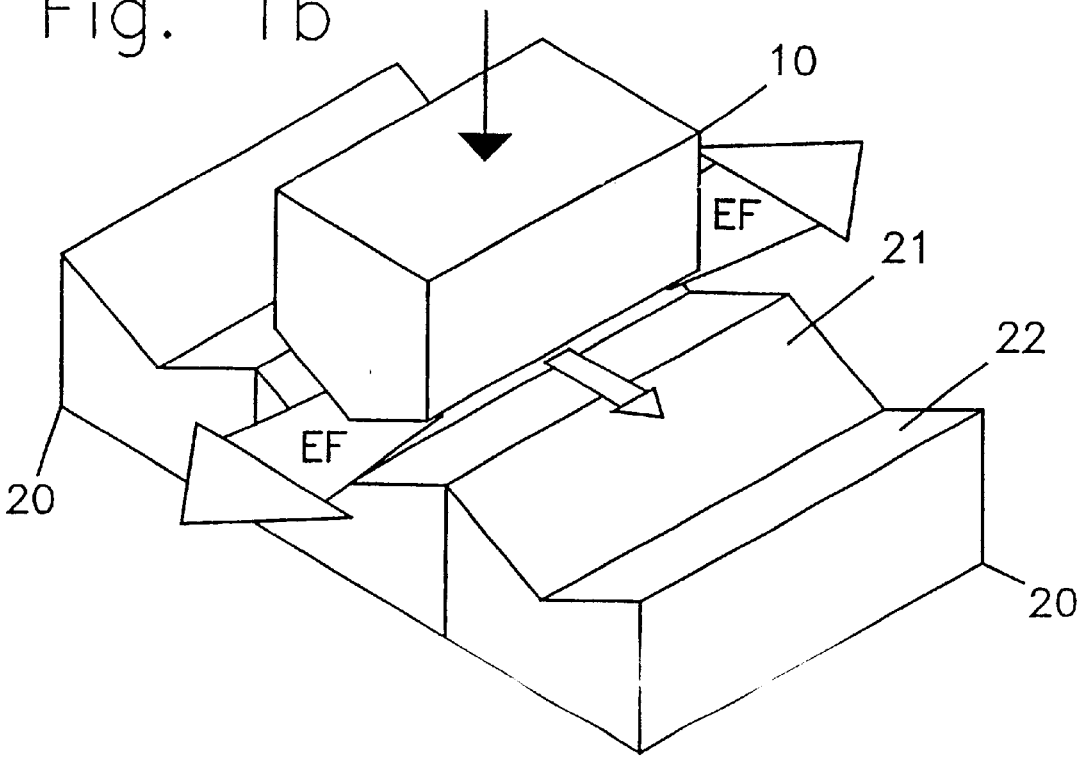

FIGS. 1(*a*) and (*b*) schematically show the electrolyte flow according to the invention in part of an aluminium electrowinning provided with sloped cathode surfaces 21, 22 on which aluminium is produced. Three juxtaposed drained cathode blocks 20 are shown, one with its facing anode 10. Each drained cathode block 20 has a sloping top surface comprising two V-shaped sloping sections 21, 22 arranged to form drained cathode surfaces on which aluminium is produced. Such cathode blocks may be manufactured by following the teachings of U.S. Pat. No. 5,683,559 (de Nora) and bonded together by a carbon-based ramming paste or glue. The cathode blocks 20 are made of carbonaceous material and their inclined top surfaces are coated with aluminium-wettable refractory material as described in U.S. Pat. No. 5,651,874 (de Nora/Sekhar). As shown, the anodes 10 are conventional blocks of pre-baked carbon which have sloping lower surfaces to provide a constant anode-cathode distance (ACD) of about 3.5 cm. However oxygen evolving non-carbon anodes may be suspended in the cell instead of the carbon anodes.

The cell is provided with a conventional superstructure including motors for displacing the anodes to set and adjust their height, the motors being controlled by a computerised system (not shown). In operation the cell further contains a fluoride-based molten electrolyte at about 950° C. wherein the anodes dip. However, the invention applies also to cells with electrolytes below 900° C., and as low as 750° C. Dissolved alumina contained in the electrolyte is electrolysed in the anode-cathode gap to produce aluminium.

FIG. 1(*a*) illustrates the raising phase of the anode 10, during which the anode 10 is raised from its operative position located at about 3.5 cm above the cathode 10 (FIG. 1(*b*)) to an upper position approximately 5.5 cm above the cathode 20. This upward movement of the anode 10 generates a depression under the anode which creates an intake flow IF of alumina-rich electrolyte into the anode-cathode gap.

Before the electrolyte has been intaken into the anode-cathode gap the electrolyte in the cell is enriched with fresh dissolved alumina. Alumina is preferably fed while the anode 10 is down in its operative position leaving as much electrolyte as possible outside the anode-cathode gap for the dissolution of fresh alumina.

After fresh alumina has been dissolved in the electrolyte, the anode 10 is raised to intake a flow IF of alumina-rich electrolyte into the anode-cathode gap.

Once alumina-rich electrolyte has been intaken into the anode-cathode gap, the anode 10 is lowered back into its operative position as illustrated in FIG. 1(*b*). The lowering phase of the anode can be done immediately after having intaken the alumina-rich electrolyte into the anode-cathode gap or can be delayed up to 10–30 seconds to allow for the electrolyte to be stabilised under the anode 10 as shown in FIGS. 4(*a*) to 4(*d*).

When the anode 10 is lowered back into its operative position the excess of alumina-rich electrolyte contained in the enlarged anode-cathode gap is evacuated in an evacuation flow EF from the gap laterally and in front of the anode.

Figure 2:
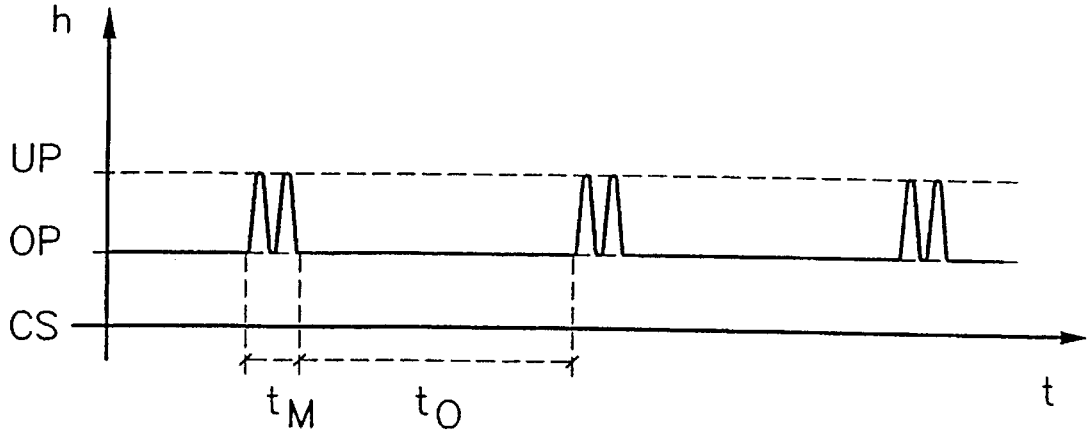
FIG. 2 is a graph showing the movements of an anode as a function of time according to one example of the invention.
Figure 3:
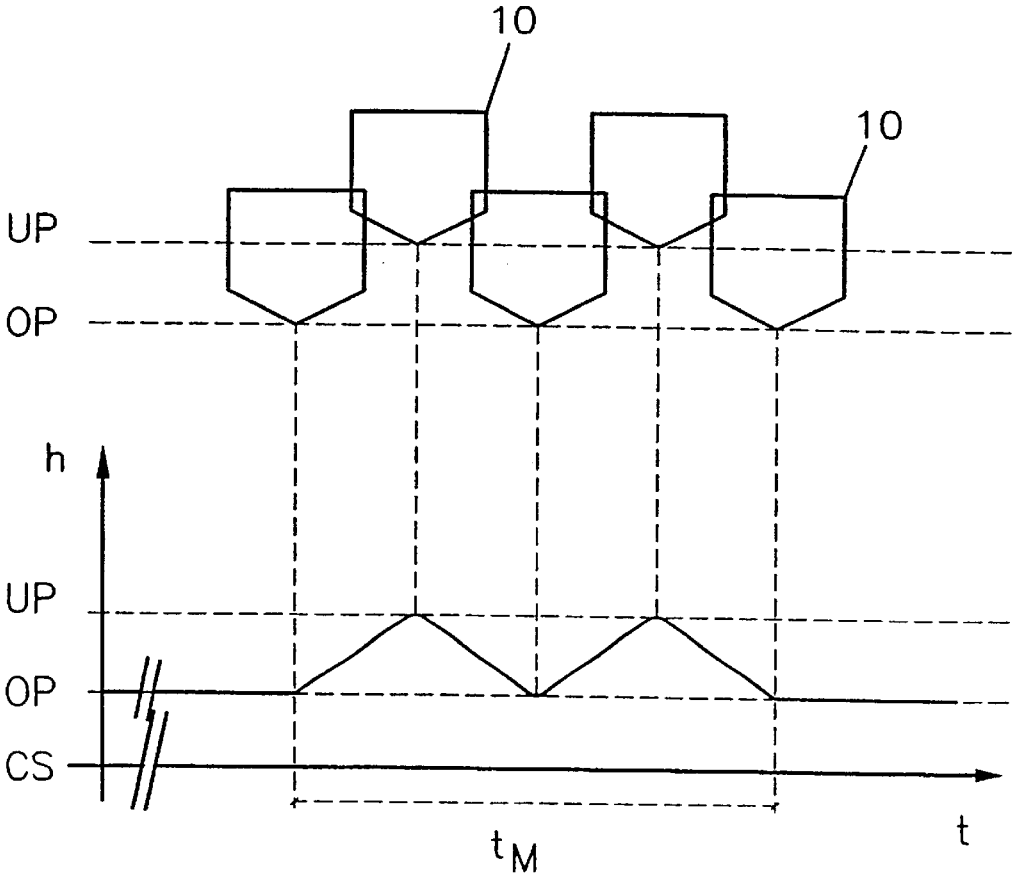
FIG. 3 is an enlarged view of part of the graph of FIG. 2 illustrating the relation between the position of the anodes and the curve shown in FIG. 2.
Figure 4A:
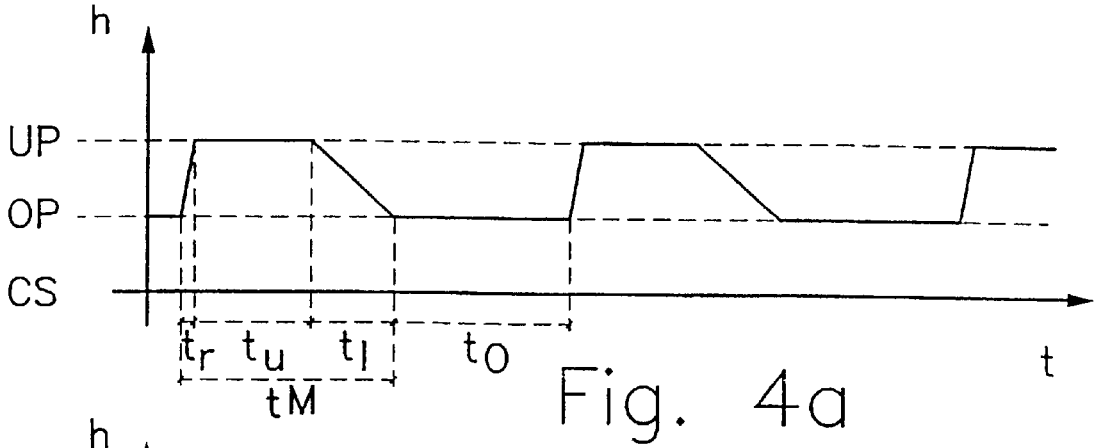
FIGS. 4(*a*), (*b*), (*c*) and (*d*) are graphs similar to FIG. 2 showing different types of anode movements.
Figure 4B:
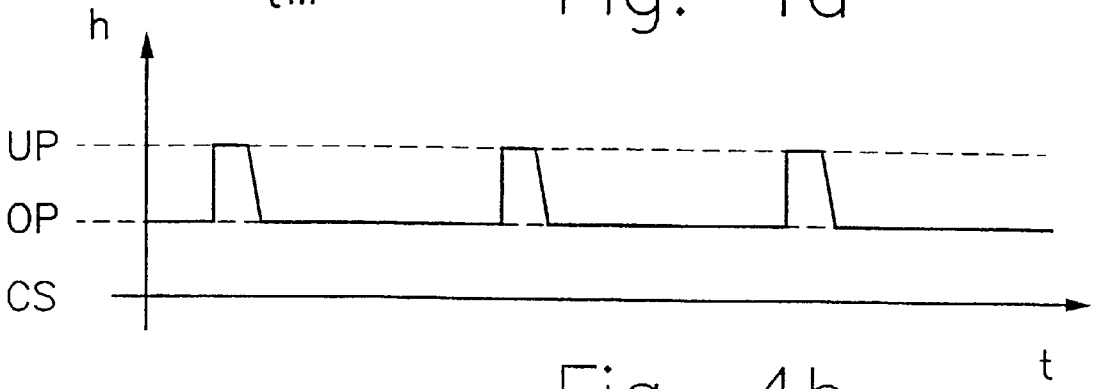
Figure 4C:
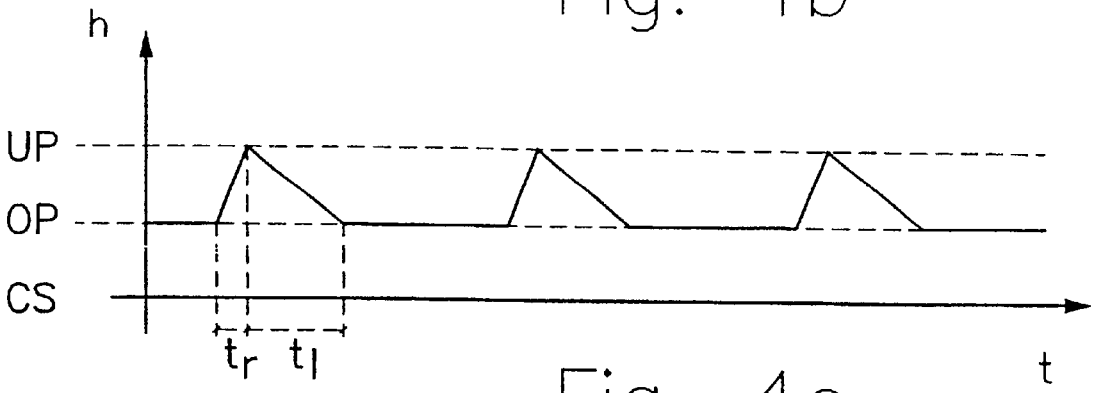
Figure 4D:
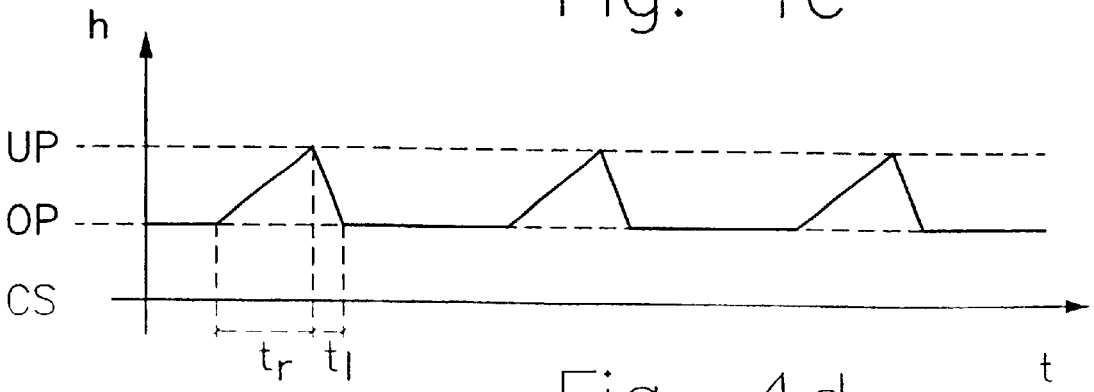

FIGS. 2 and 3 illustrate the position of an anode of a drained aluminium electrowinning cell having a V-shaped cathode (not shown) and facing anodes 10 as a function of time. The cell has a reduced anode-cathode distance (ACD) of 3 cm between the cathode sloped surfaces CS and an anode in its operative position OP. Such a cell can be manufactured by following the teachings of U.S. Pat. No. 5,683,559 (de Nora) already mentioned.

During the intake period an anode 10 for example moves up and down for a duration $t_M$ which s typically of the order of 5 to 50 seconds. Just before and possibly during this intake period, fresh alumina is fed to the electrolyte where it is dissolved before being distributed in the anode-cathode gap by means of the electrolyte intake effect generated by the anode movement. Feeding fresh alumina can be done before and possibly during the intake period. However when the intake period is over all freshly fed alumina should have been dissolved and distributed under the anode. Thus the intake period should not be ended too soon after feeding the electrolyte with alumina and the anode motion should be allowed to go on at least for a few seconds up to 1 minute.

The quantities of alumina fed during each intake period should be sufficient to keep a minimum concentration of alumina above 1 weight % near the anode surface to prevent the anode effect.

Between each successive intake period the anode 10 is in its normal operative position OP for a duration to during which alumina is electrolysed. The duration to is typically of the order of 5 to 15 minutes. In these graphs the two durations $t_M$ and to are not shown in proportion. Furthermore, only the movement of one anode is shown; however, by ways of analogy, all the anodes of the cell can be similarly moved either simultaneously or separately.

In this particular embodiment of the invention the anode 10 is raised and lowered twice between its operative position OP and an upper position UP which can be at about 3 cm above the operative position OP. After the anode 10 has been lowered back to its operative position for the second, time normal electrolysis is resumed. All fed alumina should preferably have been dissolved before raising the anode 10 for the last time to its upper position UP during an intake period.

By intaking and expelling several times the electrolyte into and from the anode-cathode gap the concentration of alumina in the anode-cathode gap is gradually increased up to the concentration of alumina around the gap where alumina is fed and dissolved.

FIGS. 4(*a*), 4(*b*), 4(*c*) and 4(*d*) similarly to FIGS. 2 and 3 illustrate different types of anode movements between their operative position OP located at about 2.5 cm above the cathode CS and an upper position UP located at approximately 4 cm above the operative position OP. The duration of the intake period $t_M$ and the duration between two intake periods to are not shown in proportion in these examples.

FIG. 4(*a*) illustrates an intake period having a duration $t_M$ of about 10 seconds, wherein the anode is raised from its operative position OP to the upper position UP during $t_r$, typically 3 seconds which generates the intake of electrolyte into the anode-cathode gap. The anode then stays for a time $t_u$ of about 5 seconds in the upper position to allow for stabilisation of the electrolyte before being slowly lowered back to the operative position during $t_1$, typically 7 seconds. These anode displacements are repeated after each consecutive rest period $t_O$ of about 10 minutes.

FIG. 4(*b*) shows a similar anode displacement as in FIG. 4(*a*), however, in this case the duration $t_u$ during which the anode is in its upper position UP is shorter, and lasts only about 2 seconds. The anode is brought back into its operative position in 2 seconds.

Too many anodes should not be raised at the same time while maintaining a constant current supply to the electrodes, because this would cause a temporary increase of the cell which is a disadvantage for normal efficient operation.

FIG. 4(*c*) similarly to FIGS. 4(*a*) and 4(*b*) illustrates the situation where the anode 10 is quickly raised to an upper position UP to intake the electrolyte from the anode-cathode gap and slowly lowered back to its operating position OP evacuating the excess of electrolyte. The raising time $t_r$ is about 3 seconds while the lowering time $t_1$ is approximately 4 seconds. In this situation the anode is immediately lowered back into its operative position after being raised to its upper position.

FIG. 4(*d*) similarly to 4(*c*) illustrates an intake sequence during which the anode is not held in its upper position UP but is lowered back to its operative position OP immediately after raising the anode. However, in this case the raising time $t_r$ is longer than the lowering time $t_l$. The duration of $t_r$ is about 4 seconds while $t_l$ lasts approximately 3 seconds.

The Figures described hereabove illustrate several manners to carry out the invention. These manners may be combined and/or modified without departing from the spirit of the invention. All numerical values and ranges are given solely by way of example.

What is claimed is:

1. A method of producing aluminium in an electrolytic cell, in particular by the electrolysis of alumina dissolved in a molten fluoride electrolyte, said cell comprising a cathode having an active cathode surface and facing anodes having active anode surfaces, each anode being spaced apart in its operative position from the cathode by an anode-cathode distance defining an anode-cathode gap containing electrolyte, the method comprising periodically moving at least one anode from and back into its operative position, feeding alumina into the electrolyte where it is dissolved to enrich the electrolyte with alumina and electrolysing in the anode-cathode gap electrolyte containing dissolved alumina, wherein said at least one anode is periodically moved along a substantially vertical direction from and back into its operative position such that electrolyte enriched with alumina is intaken into the anode-cathode gap under substantially the entire active anode surface of said at least one anode while said at least one anode is moved during an intake period.

2. The method of claim 1, wherein the cell is a drained cell having drained cathode surfaces on which aluminium is produced and from which the aluminium is continuously drained.

3. The method of claim 2, wherein the cell has an aluminium collection storage for collecting aluminium drained from the cathode surfaces.

4. The method of claim 1, wherein the anode-cathode gap when the anode is in its operative position is between 1.5 cm and 4.5 cm.

5. The method of claim 4, wherein the anode-cathode gap when the anode is in its operative position is between 2 cm and 3 cm.

6. The method of claim 1, wherein the anodes are held longer in their operative position between two intake periods than the duration of a single intake period.

7. The method of claim 1, wherein the duration between two consecutive intake periods is comprised between 1 and 20 minutes.

8. The method of claim 1, wherein fresh alumina is periodically fed into the electrolyte before and/or during an intake period.

9. The method of claim 1, wherein fresh alumina is substantially continuously fed into the electrolyte.

10. The method of claim 1, wherein the concentration of alumina in the electrolyte contained in the anode-cathode gap is maintained above 1 weight %.

11. The method of claim 1, wherein the or each anode is periodically moved according to an identically repeated sequence.

12. The method of claim 1, wherein the or each anode is moved along a substantially vertical direction during each intake period.

13. The method of claim 12, wherein the anodes are raised to an upper position and then lowered back to their operative position during each intake period.

14. The method of claim 12, wherein the anodes are raised to an upper position and then lowered back to their operative position several times during each intake period.

15. The method of claim 13 or 14, wherein the duration of raising the anodes is shorter than the duration of lowering the anodes.

16. The method of claim 13 or 14, wherein the duration of raising the anodes is longer than the duration of lowering the anodes.

17. The method of claim 1, wherein the anodes are in their operative position for a predetermined period of time between two consecutive intake periods.

18. The method of claim 1, wherein at least two anodes are synchronously moved.

19. The method of claim 1, wherein at least two anodes are asynchronously moved.

20. The method of claim 1, wherein the anodes are moved by an automated system.

21. The method of claim 1, wherein the surface of the cathode is aluminium-wettable.

22. The method of claim 1, wherein the surface of the cathode comprises at least one layer of aluminium-wettable refractory material.

23. The method of claim 1, wherein the cathode is substantially dimensionally stable.

24. The method of claim 1, wherein the anodes are substantially dimensionally stable.

25. The method of claim 1, wherein the anodes are made of carbon-free material.

26. The method of claim 1, wherein the anodes are consumable carbon anodes.

27. An electrolytic cell for the production of aluminium, in particular by the electrolysis of alumina dissolved in a molten fluoride electrolyte, said cell comprising a cathode having an active cathode surface and facing anodes having active anode surfaces, each anode being spaced apart in its operative position from the cathode by an anode-cathode distance defining an anode-cathode gap containing electrolyte, said cell having moving means for periodically moving the anodes from and back into their operative position and means for feeding alumina into the electrolyte where it is dissolved to enrich the electrolyte with alumnina, electrolyte containing dissolved alumina being electrolysed in the anode-cathode gap, wherein the moving means comprise an automated system arranged to periodically move along a substantially vertical direction at least one anode from and back into its operative position to intake electrolyte enriched with alumina into the anode-cathode gap under substantially the entire anode active surface of said at least one anode while said at least one anode is moved.

28. The cell of claim 27, wherein the surface of the cathode on which aluminium is produced is a drained surface from which the produced aluminium is continuously drained when the cell is in operation.

29. The cell of claim 28, further comprising an aluminium collection storage for collecting aluminium drained from the cathode surfaces.

30. The cell of claim 27, wherein the anode-cathode gap when the anode is in its operative position is between 1.5 cm and 4.5 cm.

31. The cell of claim 30, wherein the anode-cathode gap when the anode is in its operative position is between 2 cm and 3 cm.

32. The cell of claim 27, wherein the duration between two intake periods is longer than duration of a single intake period.

33. The cell of claim 27, wherein the duration between two consecutive intake periods is comprised between 1 and 20 minutes.

34. The cell of claim 27, wherein the moving means are so arranged as to move the anodes while and/or after fresh alumina is fed into the electrolyte.

35. The cell of claim 27, wherein the concentration of alumina in the electrolyte contained in the anode-cathode gap is maintained above 1 weight %.

36. The cell of claim 27, wherein the moving means are so arranged as to periodically move the or each anode according to an identically repeated sequence.

37. The cell of claim 27, wherein the moving means are so arranged as to periodically move the or each anode along a substantially vertical direction during each intake period.

38. The cell of claim 37, wherein the moving means are so arranged as to periodically raise the anodes to an upper position and then lower them back to their operative position during each intake period.

39. The cell of claim 37, wherein the moving means are so arranged as to periodically raise the anodes to an upper position and then lower them back to their operative position several times during each intake period.

40. The cell of claim 38 or 39, wherein the duration of raising the anodes is shorter than the duration of lowering the anodes.

41. The cell of claim 38 or 39, wherein the duration raising the anodes is longer than the duration of lowering the anodes.

42. The cell of claim 27, wherein the moving means are so arranged as to leave the anodes in their operative position during a predetermined period of time between two consecutive intake periods.

43. The cell of claim 27, wherein the moving means are so arranged as to periodically move at least two anodes synchronously.

44. The cell of claim 27, wherein the moving means are so arranged as to periodically move at least two anodes asynchronously.

45. The cell of claim 27, wherein the surface of the cathode is aluminium-wettable.

46. The cell of claim 45, wherein the surface of the cathode comprises at least one layer of aluminium-wettable refractory material.

47. The cell of claim 27, wherein the cathode is substantially dimensionally stable.

48. The cell of claim 27, wherein the anodes are substantially dimensionally stable.

49. The cell of claim 27, wherein the anodes are made of carbon-free material.

50. The cell, of claim 27, wherein the anodes are consumable carbon anodes.

51. The cell of claim 27, wherein the automated system comprises motors for moving the anodes and control means for controlling the motors.

52. The cell of claim 51, wherein the control means consists of a computerised system comprising a memory device for storing a plurality of programs for periodically generating anode movements and a programmable device for carrying out the programs contained in the memory device and to control the motors accordingly.

* * * * *